US005616054A

United States Patent [19]

Quinlan

[11] Patent Number: 5,616,054

[45] Date of Patent: Apr. 1, 1997

[54] FUSE HOLDER

[75] Inventor: Michael Quinlan, Exeter, N.H.

[73] Assignee: Gould Electronics Inc., Eastlake, Ohio

[21] Appl. No.: 550,524

[22] Filed: Oct. 30, 1995

[51] Int. Cl.[6] ..... H01R 13/68

[52] U.S. Cl. ..... 439/621; 439/831; 439/622

[58] Field of Search ..... 439/621, 830, 439/831, 832, 833, 622

[56] References Cited

U.S. PATENT DOCUMENTS

| | | | |
|---|---|---|---|
| Re. 33,877 | 4/1992 | Sappington | 439/831 |
| 945,017 | 1/1910 | Cole | 439/830 |
| 1,907,580 | 5/1933 | Ramsey | 337/187 |
| 1,938,097 | 12/1933 | Curlee | 439/830 |
| 2,938,093 | 5/1960 | McCloud | 439/830 |
| 2,943,295 | 6/1960 | Stewart | 439/831 |
| 2,958,020 | 10/1960 | Eannarino | 439/831 |
| 2,986,619 | 5/1961 | McCloud | 439/830 |
| 4,017,816 | 4/1977 | Latimer, Jr. | 439/831 |
| 4,097,114 | 6/1978 | Motten, Jr. | 439/831 |
| 4,108,531 | 8/1978 | Reynolds | 439/831 |
| 4,543,557 | 9/1985 | Schaefer | 439/621 |
| 4,547,036 | 10/1985 | Keglewitsch et al. | 439/831 |
| 4,761,148 | 8/1988 | Sappington | 439/831 |
| 4,846,738 | 7/1989 | Herbert | 439/831 |

*Primary Examiner*—David L. Pirlot
*Assistant Examiner*—Tho Dac Ta
*Attorney, Agent, or Firm*—Fish & Richardson P.C.

[57] ABSTRACT

A fuse holder including a housing defining an enclosed region and an opening to the enclosed region, a pair of contacts at opposite ends of the enclosed region and spaced to engage end cap terminals on the ends of a tubular fuse moved into the enclosed region, and a fuse carrier that is pivotally mounted on the housing at the housing opening and movable between a closed position, in which the contacts electrically engage the end cap terminals and the opening is closed by the carrier, and an open position, in which a fuse can be inserted into the fuse carrier, the fuse carrier defining an elongated fuse insertion region for receiving the tubular fuse, one end of the region being sized to receive a small diameter projection on the end of the tubular fuse but to block a full diameter end of a fuse of the same diameter, the opening to the housing being sized to permit closure of the carrier with a tubular fuse having a small diameter projection in the one end, but to block closure of a fuse having the same overall length but a full diameter end at the one end of the fuse insertion region.

5 Claims, 1 Drawing Sheet

FUSE HOLDER

BACKGROUND OF THE INVENTION

The invention relates to fuse holders.

A Class CC fuse has a small diameter projection extending from one end cap terminal, and this projection is used in fuse holders to reject fuses of similar size that do not have the small diameter projection, as shown, for example, in U.S. Pat. Nos. 4,761,148 and 4,846,738.

SUMMARY OF THE INVENTION

The invention features, in general, a fuse holder that has a housing defining an enclosed region and an opening to the region and a fuse carrier that is pivotally mounted on the housing at the housing opening and is movable between an open position and a closed position. The fuse carrier defines an elongated fuse insertion region for receiving a tubular fuse. In the open position, a fuse can be inserted into the fuse carrier. In the closed position, the end cap terminals of the fuse electrically engage contacts within the housing. One end of the fuse insertion region is sized to receive a small diameter projection on the end of a tubular fuse but to block a full diameter end of a fuse of the same diameter. The opening to the housing is sized to permit closure of the fuse carrier with a tubular fuse having a small diameter projection, but to block closure of the fuse carrier with a fuse having the same overall length, but a full diameter end.

In particular embodiments, the end of the fuse insertion region is defined by a recess that receives the small diameter projection. The recess is defined by floor extensions on two sides of the recess, the extensions supporting the large diameter portion of the end cap terminal outside of the small diameter projection. The recess is also defined by a connector between the floor extensions. In one embodiment, the fuse carrier includes a separate component that is supported by a cantilevered projection of the fuse carrier at the bottom of the fuse insertion region, and the separate component defines the recess.

Other advantages and features of the invention will be apparent from the following description of particular embodiments thereof and from the claims.

DESCRIPTION OF THE PARTICULAR EMBODIMENTS

Figure 1:
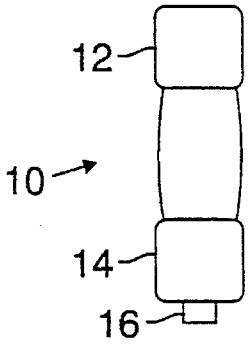
FIG. 1 is an elevation of a Class CC fuse.

Referring to FIG. 1, there is shown Class CC fuse 10 having end cap terminals 12, 14. At the bottom of end cap terminal 14 is small diameter projection 16.

Figure 2:
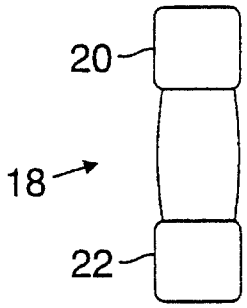
FIG. 2 is an elevation of a Midget fuse.

Referring to FIG. 2, there is shown Midget fuse 18 having the same overall length and diameter as fuse 10, but having full diameter end cap terminals 20, 22 at both ends thereof.

Figure 3:
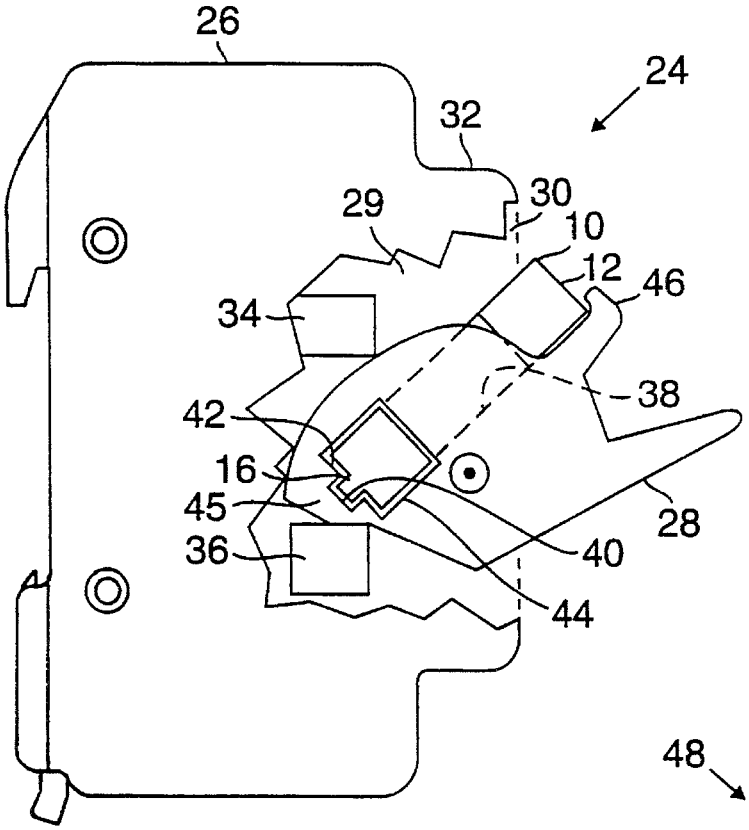
FIG. 3 is an elevation, partially broken away, of a fuse holder according to the invention.

Referring to FIG. 3, there is shown fuse holder 24 including housing 26 and fuse carrier 28. Housing 26 defines enclosed region 29 therein and opening 30 to region 29 in side extension 32 of housing 26. Within enclosed region 29 of housing 26 are a pair of U-shaped contacts 34, 36 at opposite ends of the enclosed region 29 and spaced to engage end cap terminals 12, 14 on the ends of fuse 10 when fuse 10 is moved within enclosed region 29. Fuse carrier 28 is pivotally mounted on housing 26 and is movable between a closed position (not shown), in which contacts 34, 36 electrically engage end cap terminals 12, 14, and an open position (shown in FIG. 3), in which fuse 10 can be inserted into carrier 28.

Fuse carrier 28 defines fuse insertion region 38. Recess 40 at the lower end of region 38 is sized to receive small diameter projection 16, but to block a full diameter end cap terminal such as terminals 12, 20, 22. Fuse carrier 28 has floor extensions 42, 44 at the lower end of region 38 at the two sides of recess 40. The large diameter portions outside of small diameter projection 16 of end cap terminal 14 sit on floor extensions 42, 44. End cap terminal 12 fits below tab 46 on carrier 28 at the other end of fuse insertion region 38. Connector 45 joins extensions 42, 44 and defines the bottom of recess 40.

Opening 30 to housing 26 is sized to permit closure of carrier 28 with fuse 10 carried thereon. If fuse 18 is inserted into region 38 instead, its end cap terminal 20 will be even with tab 46 and will not fit into opening 30, but will instead interfere with the roof portion of housing extension 32 over the top end of opening 30.

Figure 4:
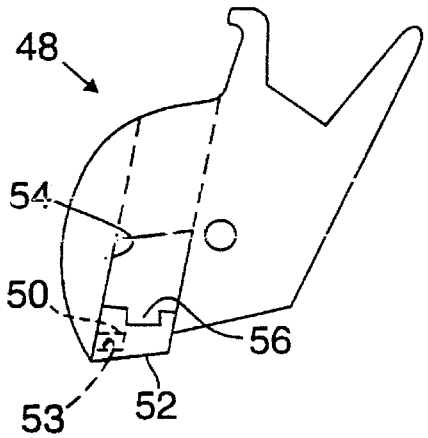
FIG. 4 is an elevation of an alternative fuse carrier for use in the FIG. 3 fuse holder.

Referring to FIG. 4, there is shown alternative fuse carrier 48. It includes a fuse carrier that is designed to accept Midget fuses and has projection 50 at the bottom of fuse insertion region 54. Projection 50 is normally used to support one side of lower end terminal 22 of Midget fuse 18 and is instead used in fuse carrier 48 to support clip-on member 52 has mating recess 53 that fits over projection 50 within the bottom of tube insertion region 54 and defines recess 56 for receiving small diameter projection 16 of Class CC fuse 10. Clip-on member 52 thus causes fuse carrier 48 to reject Midget fuse 18, but to accept Class CC fuse 10.

Other embodiments of the invention are within the scope of the following claims.

What is claimed is:

1. A fuse holder comprising a housing defining an enclosed region and an opening to said enclosed region, a pair of live contacts at opposite ends of said enclosed region and spaced to engage full diameter portions of end cap terminals on the ends of a tubular fuse moved into said enclosed region, said contacts being fixedly mounted with respect to said housing, and a fuse carrier that is pivotally mounted on said housing at said opening and is movable between a closed position, in which said contacts electrically engage said end cap terminals and said opening is closed by said carrier, and an open position, in which said tubular fuse can be inserted into said fuse carrier, said fuse carrier including structure defining an elongated fuse insertion region along a fuse axis for receiving said tubular fuse, said structure defining said fuse insertion region being inside said enclosed region and in said closed position, said structure including a blocking structure at one end of said fuse insertion region that is sized to receive a small diameter projection on the end of said tubular fuse but to block movement of a full diameter end of a fuse of the same diameter along said fuse axis into proper axial position on said carrier, said blocking structure being movable with respect to said contacts, said opening to said housing being sized to permit closure of said carrier with a tubular fuse having a small diameter projection at said proper axial position in said one end, but to block closure of said housing with a fuse having the same overall length but a full diameter end in said one end, whereby said fuse holder relies on said physical blocking to prevent electrical contact of the wrong fuse.

2. The fuse holder of claim 1 wherein said fuse carrier has a recess at said one end of said region that is sized to accept said small diameter projection but to block a full diameter end.

3. The fuse holder of claim 2 wherein said fuse carrier has floor extensions at two sides of said recess, the extensions supporting the large diameter portion of the end cap terminal outside of the small diameter projection.

4. The fuse holder of claim 3 wherein said fuse carrier has a connector between said floor extensions underneath said recess.

5. The fuse holder of claim 4 wherein said fuse carrier includes a separate component that is supported by a cantilevered projection of the fuse carrier at the bottom of said fuse insertion region and defines said recess.

* * * * *